United States Patent [19]

Blumenthal et al.

[11] Patent Number: 4,798,417

[45] Date of Patent: Jan. 17, 1989

[54] METHOD OF SEPARATING THE UPPER COAL IN SEAMS

[75] Inventors: Günter Blumenthal, Herten-Westerholt; Gustav Neu, Bochum; Karl-Heinz Berger, Gelsenkirchen; Siegmar Block, Essen, all of Fed. Rep. of Germany

[73] Assignee: Bochumer Eisenhütte Heintzmann GmbH & Co. HG

[21] Appl. No.: 96,678

[22] Filed: Sep. 14, 1987

[30] Foreign Application Priority Data

Sep. 12, 1986 [DE] Fed. Rep. of Germany ..... 3531069

[51] Int. Cl.[4] ..... E21D 23/16; E21D 23/22

[52] U.S. Cl. ..... 299/1; 91/170 MP; 299/33; 405/294; 405/302

[58] Field of Search ..... 299/1, 10, 11, 33, 32; 405/294, 303, 302; 91/170 MP, 171

[56] References Cited

U.S. PATENT DOCUMENTS

| | | | |
|---|---|---|---|
| 3,441,317 | 4/1969 | Dommann | 299/33 |
| 4,657,443 | 4/1987 | Blumenthal | 405/294 X |
| 4,693,640 | 9/1987 | Berger | 405/294 |

FOREIGN PATENT DOCUMENTS

| | | | |
|---|---|---|---|
| 154167 | 6/1952 | Australia | 299/32 |
| 590604 | 7/1947 | United Kingdom | 299/32 |

*Primary Examiner*—George A. Suchfield
*Assistant Examiner*—David J. Bagnell
*Attorney, Agent, or Firm*—Toren, McGeady & Associates

[57] ABSTRACT

A method in underground coal mining for separating the upper coal of the seam from the roof during the advancement of the upper sliding cap of a support frame, wherein the front edge of the cap is forced in a plane of the cap between the upper coal to be separated and the rock from which the coal is to be separated. During the advancement of the sliding cap, the sliding cap is alternatingly moved backwardly and forwardly, so that the from edge of the sliding cap separates the upper coal during its forward movement. Alternatively or additionally, when the front edge of the sliding cap contacts the upper coal, alternatingly higher and lower pressure can be admitted to the sliding cap in order to obtain a shaking effect. In this combined method, the sliding cap is advanced, the shaking procedure is carried out as the front edge contacts the upper coal, and the sliding cap is subsequently moved backwardly. The cycle is then repeated several times.

5 Claims, 2 Drawing Sheets

METHOD OF SEPARATING THE UPPER COAL IN SEAMS

BACKGROUND OF THE INVENTION

1. Field of the Invention

The present invention relates to a method in underground coal mining for separating the upper coal of a seam from the roof during the advancement of the upper sliding cap of a support frame, wherein the front edge of the cap is forced in a plane of the cap between the upper coal to be separated and the rock from which the coal is to be separated.

2. Description of the Prior Art

In underground mining, coal may be extracted in accordance with the longwall working method utilizing, for example, a coal plane which is moved at a certain height level between roof and footwall. In the ideal case, the coal is always separated to the level of the roof. However, in practice, geological disturbances may have the result that upper coal or residual coal remains attached to the roof. With advancing extraction, each individual support frame must be advanced in the longwall by actuating, for example, a walking legs mechanism which connects the support conveyor with the support frame. This advance movement is impaired or prevented by any upper coal remaining attached to the roof because the front edge of the cap of the support frame presses in the plane of the roof between the upper coal and the rock and the pressure may not be sufficient for separating the upper coal.

In order to facilitate the separation of the upper coal from the roof, the cap may include a wedge-type arrangement.

Similar problems occur in shield-type support frames with packing caps which are advanced together with the support conveyor in order to close open spaces. This is because any remaining residual coal may block the advancement of the packing or sliding cap. To ensure that this cap contributes to the separation of the upper coal, this cap can be provided with a separating wedge or a tearing ledge. However, it happens again and again that the force available for advancing the cap is not sufficient for separating the upper coal.

It is, therefore, the primary object of the present invention to further develop a method of the above-described type in such a way that the separation of the upper coal is facilitated or made possible, without requiring complicated or expensive apparatus.

SUMMARY OF THE INVENTION

In accordance with a first embodiment of the present invention, the sliding cap is moved several times back and forth during the advancement thereof in such a way that the cap is thrust between the upper coal and the rock during several successive advance movements of the cap.

In the past, the hope was that the advancement of the sliding cap will cause the front edge of the cap to separate the upper coal. In accordance with the present invention, on the other hand, the sliding cap is moved back and forth so that the cap punches its way forwardly.

Particularly if the sliding cap is advanced synchronously with the advancement of a support conveyor by means of a synchronization control, it is advantageous to superimpose a thrust control over the synchronization control. This thrust control moves the sliding cap during its advancement back and forth with a frequency which can be selected. The frequency may be given by a manual control. The frequency is related to the amplitudes of the forward and backward strokes of the sliding cap. The sliding cap may be provided with a bearing ledge or the like. In this method, the sliding cap punches its way forwardly until synchronized movement with the support conveyor has been reached.

For an automatic separation of the upper coal by means of the sliding cap, the relative position between the walking legs of the support frame and the sliding cap is determined by means of distance sensors in connection with an electronic circuit. When the determined relative position corresponds to a desired value or a desired value range, a distance synchronization between sliding cap and walking legs is carried out. When the determined relative position does not correspond to the desired value or a desired value range, the electronic control initiates a cyclical forward and backward movement of the sliding cap. This cyclical forward and backward movement of the sliding cap is carried out until the determined relative position finally corresponds to a desired value or a desired value range.

It may happen that the upper coal is so firmly attached to the rock that it cannot be separated even when several thrust attempts are carried out. Therefore, it may be advantageous to stop the attempted separation of the upper coal after a certain period of time has transpired. In this situation, the upper coal must be separated by a suitable hand tool.

In accordance with a second embodiment of the present invention, high pressure and low pressure are alternatingly applied several times on the sliding cap when the advancement of the sliding cap is stopped by upper coal. This alternating application of pressure results in a shaking or vibration effect during which the front edge of the sliding cap permanently rests against the upper coal. This shaking effect can be obtained by a special hydraulic control unit which is integrated into the hydraulic system for the advancement of the sliding cap. The frequency of the pressure application and/or the duration of the pressure application and/or the magnitudes of the low pressure and of the high pressure can be suitably adjusted.

In accordance with a third embodiment of the present invention, the methods of the first and second embodiments are combined. In accordance with this third embodiment, the sliding cap is thrust against the upper coal during the advancement of the sliding cap. Subsequently, alternating low and high pressures are applied to the sliding cap in order to obtain the shaking effect. This shaking effect may continue for a predetermined period of time. Subsequently, the sliding cap is moved back by a certain distance. The above-described cycle is then repeated. Accordingly, in combination with the synchronization control, the sliding cap carries out alternating movements for thrusting forwardly and for separating the upper coal until the distance synchronization between support conveyor and sliding cap has been reached.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 2:
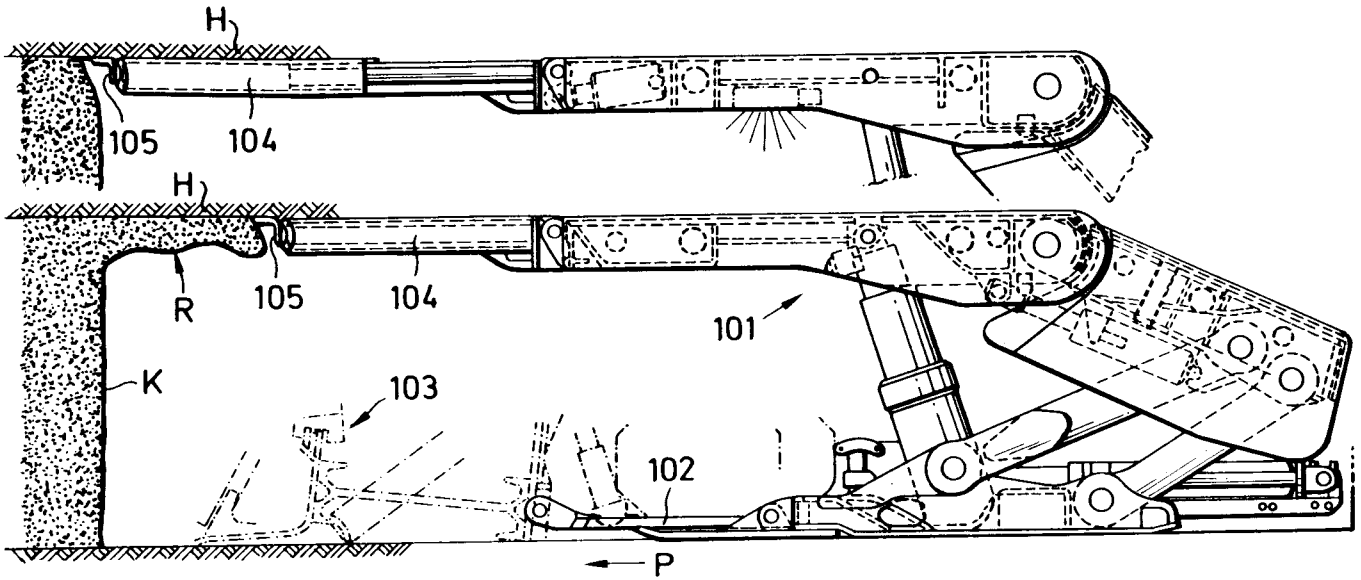
FIG. 2 is a schematic elevational side view of a shield-type support frame in the longwall, wherein the lower portion of the figure shows a non-extended sliding cap pressing against the upper coal, while the upper portion of the figure shows an extended sliding cap which has separated the upper coal from the roof.

Referring first to FIG. 2 of the drawing, a shield-type support frame 1 is connected in the region of the footwall of the longwall through a connecting rod 102 to a support conveyor 103, only illustrated schematically. A hydraulically movable packing cap or sliding cap 104 is coupled through a synchronization control to the support conveyor 103, so that, with advancing working at the coal face K, the support conveyor 103 is advanced through connecting rod 102 by means of a hydraulic system, not illustrated in detail, and the sliding cap 104 is synchronously advanced with the support conveyor 103. The sliding cap 104 has the purpose to uphold the roof and to close empty spaces.

As illustrated in the lower portion of FIG. 2, upper coal or residual coal R may remain attached to roof H. For separating this upper coal R, the sliding cap 104 has at its front edge a tearing ledge 105 which is pushed in the plane of the upper side of the sliding cap 104 between the rock and the upper coal R, so that the upper coal R is separated and the path is cleared for the advancing sliding cap 104. When the upper coal R has been separated, sliding cap 104 can uphold the exposed roof H. Sliding cap 104 is now approximately at the same level as the support conveyor 103.

In order to advance the sliding cap 104, a certain pressure is applied to a hydraulic cylinder which is coupled to the sliding cap. If this pressure is not alone sufficient to separate the upper coal R from the roof H, the method in accordance with the present invention is utilized.

The present invention is directed to altogether three different embodiments which are explained in more detail as follows.

The support conveyor 103 is advanced in the direction of arrow P. At the same time, sliding cap 104 is advanced. However, the advancement of the sliding cap 104 is not continuous, but rather is carried out with forward and backward movements. During the backward movement of the sliding cap 104, the front edge of the tearing ledge 105 is moved a certain distance away from the upper coal R. During the forward movement of the sliding cap 104, the front edge of the tearing ledge 105 is thrust between the roof H and the upper coal R. The tearing ledge of the cap 104 acts on the upper coal R with an energy which depends upon the mass of the sliding cap, the force supplied for moving the sliding cap and the speed of the sliding cap. The backward movement and the subsequent forward movement of the sliding cap are repeated several times, so that the sliding cap punches its way forward as it separates individual pieces of the upper coal.

The control of this punching movement is not illustrated in detail. In accordance with a feature of the present invention, the control can be carried out manually by appropriately actuating the hydraulic cylinder coupled to sliding cap 104. However, an automatic control can be provided. This automatic control operates by means of distance sensors, not shown, which determine the relative position of the support conveyor 103 and the sliding cap 104. The control causes a cyclical forward and backward movement of the sliding cap 104 until the relative position between support conveyor 103 and sliding cap 104 corresponds to a predetermined desired position.

A second embodiment of the method for separating the upper coal R from the roof H in accordance with the present invention provides that the sliding cap 104, after having been pressed against the upper coal R, carries out a shaking movement with its tearing ledge 105. This shaking movement is carried out by alternatingly applying a relatively low pressure and a relatively high pressure to the hydraulic system which operates the sliding cap 104. The low pressure is lower than the pressure with which the sliding cap 104 is advanced when no obstacle, i.e., upper coal, is present. The higher pressure mentioned above, on the other hand, is greater than the pressure applied when no obstacle is present. During this shaking procedure, the front edge of the tearing ledge 105 remains in contact with the upper coal R until the upper coal R is separated. Of course, the shaking procedure is carried out only for a limited period of time. If the upper coal R is not separated from the roof after a certain period of time, it may become necessary to use a hand tool for separating the upper coal.

The third embodiment of the present invention constitutes a combination of the two above-described methods. The punching movement of the sliding cap 104 described above is superimposed by a shaking movement. If, during the cyclical advancement of the sliding cap, the front edge of the tearing ledge 105 makes contact with the upper coal R, the above-described shaking procedure is initiated for a certain period of time, unless the first contact of the tearing ledge with the upper coal separates the upper coal. If the upper coal is not separated, the shaking procedure is concluded after a certain period of time has elapsed and the sliding cap 104 is again moved back by a certain distance and, subsequently, is again moved forwardly until the front edge of the tearing ledge makes contact with the upper coal R. This combined punching and shaking procedure is carried out until synchronization with the advance movement of the support conveyor 103 is reached.

In the following, an example of a shaking control unit in accordance with the present invention shall be described. This example is capable of carrying out the second method described above and parts of the third method described above.

Figure 1:
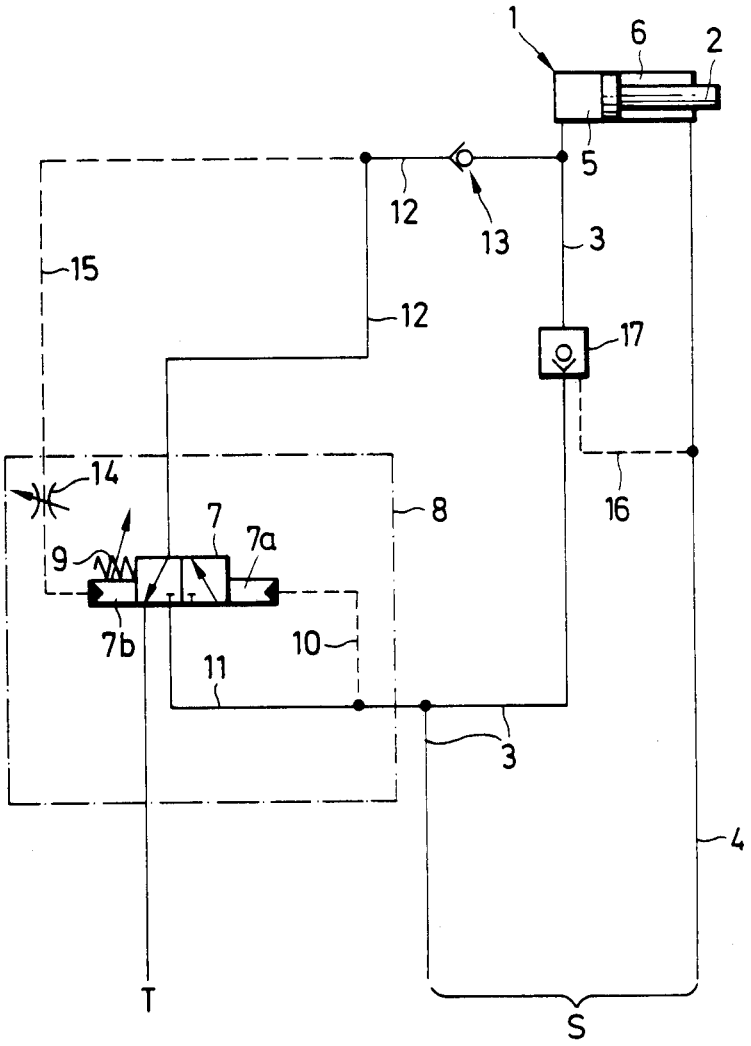
FIG. 1 is a hydraulic circuit diagram of a shaking mechanism in accordance with the present invention.

As illustrated in FIG. 1 of the drawing, the shaking device includes a double-acting cylinder 1 whose piston rod 2 moves the sliding cap of the shield-type support frame illustrated in FIG. 2. This movement is carried out in synchronization with the advancement of the support conveyor 103.

The unit for the synchronization control is not illustrated in detail but is denoted by reference symbol S. The unit acts on two hydraulic lines 3 and 4, wherein line 3 is 3 is connected to the piston space 5 and line 4 is connected to annular space 6 of cylinder 1. By admitting pressurized fluid to the annular space 6, the sliding cap is retracted by means of piston rod 2. If pressurized fluid is admitted to piston space 5 through line 3, the piston 2 moves the sliding cap toward the coal face K. In doing so, a certain pressure is reached in line 3.

If the forward edge of the cap makes contact with an obstacle, for example, residual coal which has remained attached to the roof, the piston rod 2 comes to a standstill if the residual coal is not pushed off by the cap which is moved forwardly with normal force. As a consequence, the pressure in line 3 rises.

A three/two-way valve 7 of a shaking control 8 includes a first larger control area 7*a* and a second smaller control area 7*b*. An adjustable compression spring pretensions the valve 7 in the zero position illustrated in FIG. 1. When normal pressure is present in line 3 during the advancement of the piston rod 2, the pressure acting through control line 10 on the control area 7*a* is not sufficient to switch the valve against the force of compression spring 9. However, when the pressure in line 3 is increased as the residual coal stops the advancement of the piston rod 2, valve 7 is suddenly opened and spring 9 is compressed when a certain limit value of valve 7 adjusted by means of compressions spring 9 has been reached. As a result, the increased pressure in line 3 and in branch line 11 connected to line 3 is built up suddenly in the piston space 5 of cylinder 1 through valve 7, a line 12 and a check valve 13. This increased pressure provides the front edge of the sliding cap, constructed as a tearing ledge, with increased force between the residual coal which has remained attached to the roof and the rock.

The increased pressure in line 12 additionally acts on control area 7*b* of valve 7 through control line 15 which contains a throttle 14. Together with the pressure generated by compression spring 9, this increased pressure is sufficient to switch back valve 7, so that line 12 is again connected to a return tank T, as is control line 15, however, the latter connection being effected with a time delay caused by throttle 14.

If the obstacle of residual coal is still present, the above-described conditions again prevail and the above-described procedure is repeated with a frequency which can be adjusted by throttle 14. Accordingly, the front edge of the sliding cap acts on the residual coal at the contact point alternatingly with high and low pressure, i.e., in a pulse-like manner. This makes it possible to separate the residual coal.

A control line 16 connects line 4 to check valve 17 which can be unlocked. Check valve 17 prevents the pressure from decreasing in the piston base 5 and in line 3 during the shaking procedure. During manual operation, piston rod 2 is retracted by applying pressure to the annular space 6 through line 4. By unlocking check valve 17 through control line 16, the pressure prevailing in piston space 5 can be released into line 3.

While specific embodiments of the invention have been shown and described in detail to illustrate the application of the inventive principles, it will be understood that the invention may be embodied otherwise without departing from such principles.

We claim:

1. A method for separating the upper coal of a seam from the roof during the advancement of an upper sliding cap of a shield-type support frame, wherein a front edge of the cap is forced in a plane of the cap between the upper coal to be separated and the rock from which the coal is to be separated, and wherein the shield-type support frame is connected to a support conveyor through walking legs comprising moving the sliding cap backwardly and forwardly for several times during the advancement of the sliding cap, so that the cap is thrust between the upper coal and the rock during several successive advance movements of the cap and the steps of:

(a) determining the relative position between walking legs and sliding cap by means of distance sensors and an electronic circuit, and (b1) if the determined relative position corresponds to a desired value or a desired value range, carrying out a distance synchronization between sliding cap and walking legs, or (b2) if the determined relative position does not correspond to the desired value or the desired value range, carrying out a cyclical forward and backward movement of the sliding cap, wherein the cyclical forward and backward movement is effected by the electronic circuit.

2. The method according to claim 1, wherein the sliding cap is advanced synchronously with the advancement of a support frame by means of a synchronization control, comprising superimposing a thrust control over the synchronization control, the thrust control moving the sliding cap during the advancement thereof backwardly and forwardly with a selectable frequency.

3. The method according to claim 2, wherein the frequency is manually controlled, comprising correlating the frequency to the amplitudes of the forward and backward movement of the sliding cap.

4. The method according to claim 2, comprising superimposing the thrust control as a programmed control over the synchronization control, wherein the thrust control is programmed in such a way that the forward and backward movements of the sliding cap are caused until synchronization between sliding cap and support frame is reached.

5. The method according to claim 1, comprising stopping step (b2) after a certain of period of time has elapsed and the relative position does not correspond to the desired value of the desired value range.

* * * * *